US007735815B2

(12) United States Patent
Otten

(10) Patent No.: US 7,735,815 B2
(45) Date of Patent: Jun. 15, 2010

(54) HOLDING DEVICE FOR GENERATING A RETAINING PRESSURE ON AN AIRPLANE COMPONENT

(75) Inventor: Juergen Otten, Tiste (DE)

(73) Assignee: Airbus Deutschland GmbH, Hamburg (DE)

( * ) Notice: Subject to any disclaimer, the term of this patent is extended or adjusted under 35 U.S.C. 154(b) by 227 days.

(21) Appl. No.: 11/090,922

(22) Filed: Mar. 24, 2005

(65) Prior Publication Data

US 2005/0236756 A1 Oct. 27, 2005

Related U.S. Application Data

(60) Provisional application No. 60/606,647, filed on Sep. 2, 2004.

(30) Foreign Application Priority Data

Mar. 27, 2004 (DE) ..... 10 2004 015 172

(51) Int. Cl.
*B25B 5/16* (2006.01)

(52) U.S. Cl. ..... 269/266; 269/32; 29/281.1; 29/281.6

(58) Field of Classification Search ..... 269/266, 269/32, 20, 289 R; 29/281.1, 281.6
See application file for complete search history.

(56) References Cited

U.S. PATENT DOCUMENTS 1,453,176 A * 4/1923 Perrine ..... 269/266
4,560,152 A * 12/1985 Miller ..... 269/24
5,067,694 A * 11/1991 Rypka ..... 269/20
5,224,586 A * 7/1993 Naka et al. ..... 198/803.11
5,979,267 A 11/1999 Yonezawa
5,984,293 A * 11/1999 Abrahamson et al. ..... 269/266
6,711,797 B1 * 3/2004 Bennett et al. ..... 29/281.6
6,775,904 B1 * 8/2004 Duebel ..... 29/760
6,953,188 B2 * 10/2005 Siegel ..... 269/266
7,000,911 B2 * 2/2006 McCormick et al. ..... 269/239
2002/0050672 A1 * 5/2002 Moncavage ..... 269/266
2005/0082731 A1 * 4/2005 Moore et al. ..... 269/266
2005/0236756 A1 * 10/2005 Otten ..... 269/266

(Continued)

FOREIGN PATENT DOCUMENTS

DE 41 10 328 10/1992

(Continued)

*Primary Examiner*—Lee D Wilson
(74) *Attorney, Agent, or Firm*—W. F. Fasse; W. G. Fasse

(57) ABSTRACT

A holding device produces a retaining pressure on a contoured airplane component (40) for holding the component in place when work is performed on the component. For this purpose the holding device (10) comprises a support (11) and at least one holding element (16) connected to the support (11) and projecting from the support (11) for contacting the contoured airplane component (40) in a holding zone. A spacing between a contact area of the holding element (16) and the support (11) is adjustable in accordance with the contour of the airplane component (40) in the holding zone. The adjustment of the position of the holding element relative to the support (11) moves the holding element (16) more or less against the surface contour so that the holding force is applied exactly where needed on the holding zone. A plurality of holding elements can be advanced toward the surface contour to variable extents so that all contact areas together conform to the surface contour.

11 Claims, 1 Drawing Sheet

U.S. PATENT DOCUMENTS

2006/0244190 A1* 11/2006 Erdmann ..... 269/266

FOREIGN PATENT DOCUMENTS

Figure 1:
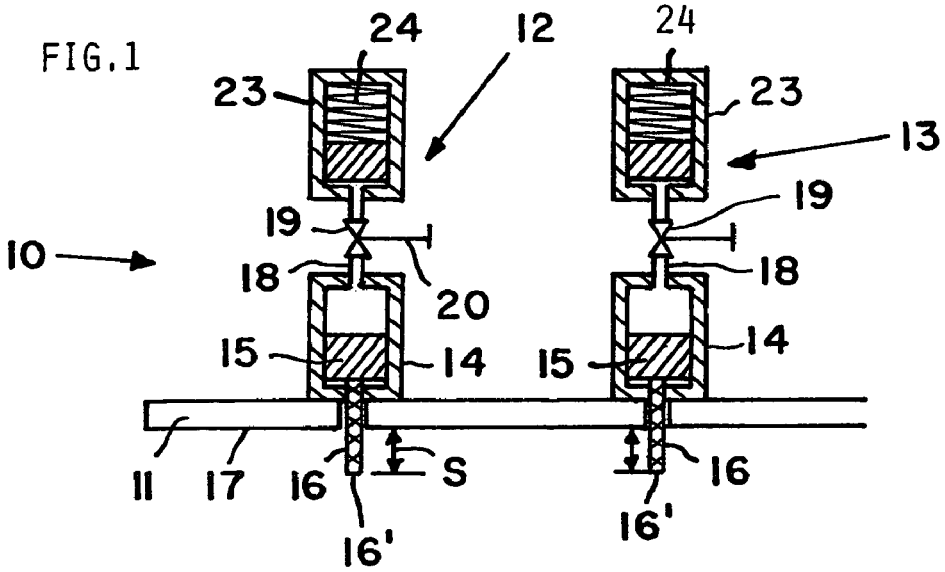

DE 41 35 490 1/1993
DE 42 03 992 5/1993
DE 100 23 921 11/2001
DE 697 31 933 12/2005

* cited by examiner

HOLDING DEVICE FOR GENERATING A RETAINING PRESSURE ON AN AIRPLANE COMPONENT

CROSS-REFERENCE TO RELATED APPLICATION

This U.S. Non-Provisional Application claims the benefit under 35 U.S.C. §119(e) of U.S. Provisional Application 60/606,647, filed on Sep. 2, 2004, the entire disclosure of which is incorporated herein by reference.

PRIORITY CLAIM

This application is based on and claims the priority under 35 U.S.C. §119 of German Patent Application 10 2004 015 172.5, filed on Mar. 27, 2004, the entire disclosure of which is incorporated herein by reference.

FIELD OF THE INVENTION

A holding device for generating a retaining pressure on an airplane component has a support and at least one holding element held by the support and projecting from the support for contacting the airplane component in a holding zone. The spacing of the contact area of the holding element from the support is set in accordance with the contour of the airplane component in the holding zone.

BACKGROUND INFORMATION

When working an airplane component, for example when drilling holes in an airplane component with a drilling unit, a holding device is used in order to apply a holding pressure to the airplane component, such as two skin sections that may not shift relative to each other while drilling continues. The holding pressure counteracts the force applied by the drilling unit to the airplane component. Such a holding pressure may, for example, also be required for preventing the entry of drilling chips into intermediate spaces between airplane components to be interconnected. Conventionally, a support plate with a plurality of holding pins is, for instance, provided for a determined zone on the surface of an airplane component. Depending on the contour of the airplane component in this zone the holding pins project out of the support plate by an individually set spacing in which the pins remain in order to achieve a contour true adaptation and thus a uniform holding pressure of the holding pins in the determined zone on the airplane component. Thus, for each determined zone of the surface of an airplane component a holding device is required that is individually adapted to the respective contour. Once the contour defined by the pin ends is set, the holding device can be used only on an airplane component zone having the same surface contour. The set pins can not be used on any other surface contour. Therefore, the stocking and handling of a multitude of individual holding devices is unavoidable, complicated, and expensive. Thus, keeping many holding devices in stock is not economical, particularly if airplane component contours deviate significantly from a standard contour. Further, some pins may contact the component surface while some may not. Thus, there is the danger that drilling chips enter into the intermediate spaces between two airplane components to be interconnected.

SUMMARY OF THE INVENTION

It is an object of the invention to provide a holding device that can be handled simply and quickly, that requires a small effort and expense, and that is particularly exactly adaptable to any different surface contour. It is another object to make the pin position individually variable or adjustable so that the tips of all pins together can form or rather conform to different contours, so that each pin is individually settable or lockable in different contour defined positions.

It is still another object to permit all holding pins to automatically adjust their position relative to any surface contour in unison simply by setting the holding device onto the respective surface contour and then individually lock the pins in place until another contour needs to be held down.

These objects have been achieved according to the invention in that the holding element is shiftable or adjustable relative to the support so that the spacing of the contact area of the holding element from the support is variable. In the embodiment with a plurality of holding pins the tips of the pins form the contact area. This adjustment makes it possible that the holding device, when applied to the airplane component surface, adapts itself to the respective component contour by shifting of the at least one holding element. Thus, a single holding device preferably having a plurality of holding sections is universally adaptable to and useable for a plurality of differing contours on the surface of an airplane component, whereby the number of holding devices to be stocked is reduced and thus the effort and expense is correspondingly reduced. A manual adjustment of the at least one holding element is not necessary. The holding device can be used sequentially for different component zones by resetting. This feature assures a swift work flow.

The holding device preferably comprises a locking mechanism for temporarily locking the at least one holding element in a fixed position relative to the support. After the holding device has been applied to the airplane component and the holding element has been adapted or adjusted to the component contour by freely shifting the holding element relative to the support plate toward or away from the surface contour, the locking mechanism is operated so that the holding element can exert a holding pressure on the airplane component. The locking mechanism may preferably be controllable, for example electrically, pneumatically or hydraulically. However, the invention also encompasses a manual activation of the locking mechanism. Further, one locking mechanism is preferably allocated to a plurality of holding elements in order to quickly and simultaneously lock all the holding elements in position.

Preferably, the holding element is hydraulically shiftable or adjustable. Thereby, particularly the locking of the holding element is especially simply realized by closing the hydraulic system, for example, by simply closing a valve. The invention, however, also encompasses electrically shiftable holding elements, for example by an electric motor.

In another embodiment the adjustment of each holding element is controllable with regard to its shifting relative to the support or support plate. Thus, each holding element can then be adjusted contour-true for the use in a determined holding zone of an airplane component. This feature makes it possible, for example, to store in a memory the adjustment of the holding elements for different component contours and to automatically make a respective adjustment depending on the desired use of the holding device, more specifically depending on the surface contour to be held. The adjustment values to be stored can be ascertained by means of a calibration of the holding device.

The invention further aims to avoid or overcome the disadvantages of the prior art, and to achieve additional advantages, as apparent from the present specification. The attainment of these objects is, however, not a required limitation of the claimed invention.

BRIEF FIGURE DESCRIPTION

Figure 2:
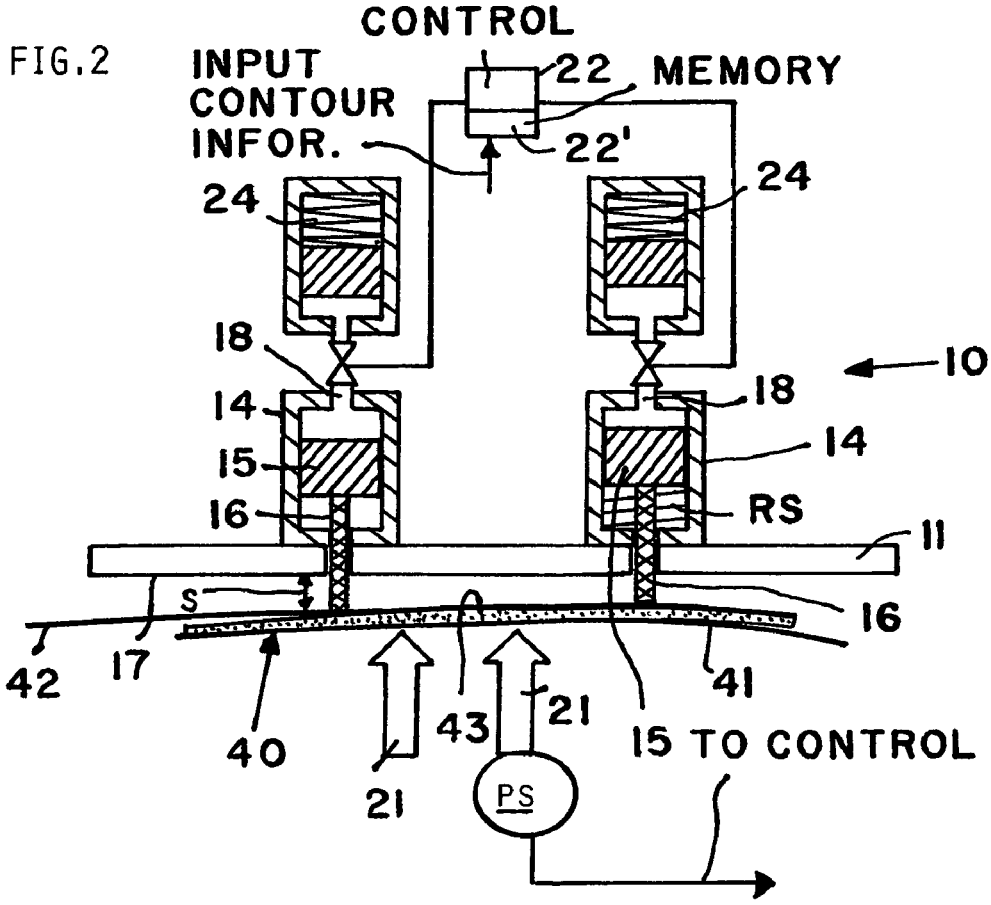

In order that the invention may be clearly understood, it will now be described in connection with example embodiments thereof, with reference to the accompanying drawings, wherein:

FIG. 1 shows a cross-sectional view of a holding device in a rest position; and FIG. 2 shows a cross-sectional view of a holding device set on an airplane component.

DETAILED DESCRIPTION OF A PREFERRED EXAMPLE EMBODIMENT AND OF THE BEST MODE OF THE INVENTION

A holding device 10 comprises a support plate 11 and at least one, preferably a plurality of holding sections 12, 13 mounted on the support plate. In this example the holding sections 12, 13 are equally constructed. However, such identical construction is not necessarily the case. For example, each holding section may be constructed with due regard to its position within a group of holding devices. Each holding section 12, 13 comprises for example a hydraulic cylinder 14 with a piston 15 shiftable in the cylinder to form a drive for a holding element 16 such as a pin. The piston 15 is connected with the pin 16 which is guided through a hole in the support plate 11 and which projects from a surface 17 of the support plate 11 facing toward an airplane component 40 to be held. The hydraulic cylinder 14 is filled with hydraulic liquid on the side of the piston 15 opposite the pin 16. The cylinder 14 has a port 18 connected to a hydraulic liquid reservoir 23. The port 18 is closeable by a valve 19 that provides either a manual or an automatic control for locking the respective pin 16 or pins in a fixed position by closing the valve 19. For example a reset spring RS shown in FIG. 2 may be provided in the cylinder to return the piston with the pin into a starting position when the pressure on the opposite end of the piston is released. However, such a reset spring is not necessary if all pins 16 project completely out of the support plate 11 when the pins are in a rest or starting position as shown in FIG. 1 where all pins 16 with their surface contact areas 16' extend maximally out of the support plate 11 with a spacing S between the contact area 16' and the downwardly facing surface of the support plate 11.

FIG. 1 shows the projected rest or starting position of the holding device 10 in which the pins 16 of two holding sections 12, 13 project maximally out of the support plate 11. When the holding device 10 is now set onto a contoured surface 43 of an airplane component 40 the pins 16 will more or less move back into the cylinder 14 as shown in FIG. 2 where the spacings S differ from each other so that the contact areas 16 of the pins 16 conform to the surface contour 43. The airplane component 40 comprises for example a section of an outer airplane skin 41 and a section of an inner airplane skin 42. A certain holding zone of the component skin sections 41, 42 is to be worked, for example by drilling. These skin sections 41, 42 may be part of an airplane wing. In the area to be worked the contoured surface 43 of the airplane component 40 has a determined curved shape, i.e. the surface is not plane. When the holding device 10 is set onto the contoured surface 43 of the airplane component 40 in the zone to be worked, the pins 16 of the two holding sections 12, 13 are shifted by the contact force relative to the hydraulic cylinders 14 or relative to the support plate 11. The size of the shifting of the pins 16 depends on the contour of the airplane component 40 at the position of the respective pins 16 so that an individual adaptation of the pins 16 of the holding device 10 to the contour 43 of the airplane component 40 takes place. The shifting of the piston 15 displaces a corresponding quantity of hydraulic liquid out of the hydraulic cylinder 14 through the port 18.

The valve 19 is closed when all pins 16 are in the holding position, i.e. when all pins 16 of the holding sections 12, 13 contact the airplane component 40. The closing of the valve 19 can be performed, for example, by an electric, a hydraulic or a pneumatic, an electromagnetic, or a piezo-electric control signal through a control conductor 20. The holding device 10 comprises for this purpose preferably an electronic control mechanism 22. A manual operation of the valve 19 is also possible. Furthermore, rather than providing the hydraulic liquid reservoir 23 individually for each holding section 12, 13 as shown in FIG. 1, a single reservoir may be provided in common for several or all holding sections 12, 13. In that case the use of a single valve for closing the reservoir may be sufficient, so that a separate valve 19 for each holding section 12, 13 is not necessary.

Due to the incompressibility of the hydraulic liquid the position of the respective pin 16 is located in a fixed position when the valve 19 is closed. If now a counter force 21 is exerted on the airplane component 40 on its side opposite the holding sections 12, 13 as schematically indicated by the arrows 21 in FIG. 2, the airplane component 40 is pressed against the holding sections 12, 13 or rather against the contact areas 16' of all the pins 16 which are now in a contour true position. The pins 16 exert a holding force on the airplane component 40 that is opposed to the counter force 21 in order to hold the component in accordance with its contour. Thus, an exact adaptation of the holding pins or elements 16 to the shape of the airplane component 40 is assured in a contour true manner. Incidentally, the holding areas 16' may themselves have component facing contours. Additionally, the holding areas 16' may be formed by exchangeable pin tips which have different contours, whereby the contour true contact is improved. The pins themselves may be exchangeable for pins with differently contoured tips.

The valves 19 are opened again upon completion of the working of the airplane component 40. The holding device 10 may then be set onto another area to be worked of the airplane component, whereby the holding elements or pins 16 again adapt themselves to the respective surface contour of the airplane component. Thereafter, the valves 19 are individually closed again. Thus, the holding device 10 is a universal holding device which is adaptable within wide ranges, to any desired surface contours of airplane components or any other contoured surfaces.

The holding device 10 preferably comprises a mechanism for producing a biasing force on the holding element or pin 16 effective in the direction of the airplane component 40 to be held, for example, by a spring 24. The biasing force of the spring assures that in the rest position of a holding section 1.2, 13, that is in a state when the device 10 is not set on an airplane component, the pins 16 project maximally out of the support plate 11 with the spacing S. Thus, following removal of the holding device 10 out of contact with a component contour and opening of the valve 19, the pins are automatically reset into a rest position, which is also the starting position. From this rest position an adaptation to any randomly shaped surface of an airplane component is possible.

The holding device preferably comprises a pressure metering or sensor device PS for measuring the pressure exerted by the airplane component on the holding device. This may, for example, be a device for measuring the hydraulic liquid pressure. The pressure signal thus measured may serve for monitoring the operation or, for example as a control value for controlling the valves 19.

When the pin or pins 16 are shifted by an electric drive the locking of the position of the pins 16 is achieved by switching off an electric drive. For this purpose the electric drive is preferably electrically controllable. Initially all pins 16 are suitably held in a maximally recessed position relative to the support plate 11. Then, the support plate 11 is placed in the zone of the surface 43 of the airplane component 40 to be worked and the pins 16 are driven out until they are in contact with the surface 43 of the airplane component 40. Preferably, an electronic control circuit 22 is provided, which switches off the electric drive when the counter force 21 exerted by or on the airplane component 40 and on the pins 16 reaches a predetermined value as measured by a pressure measuring device such as a pressure sensor PS. The output of the sensor PS is supplied to an input of the control 22. Another embodiment provides the electronic control circuit 22 with a memory 22'. A contour representing program is stored in the memory 22' and used for controlling the position adjustment of the pins.

In the embodiment wherein the pins are driven by an electric drive, the contact pressure is preferably ascertained from rated values of the electric drive. For example, the rise of the power consumption of an electric drive motor in response to the pins 16 contacting the surface contour 43, may be used to generate a control signal for closing the valves to thereby lock the pins in their surface contacting position without further increasing the driving pressure while maintaining the contact pressure. Instead, the above mentioned pressure sensor PS may be used to provide a control signal for the valves 19. The control circuit is preferably so constructed, that the pins 16 are automatically returned into the rest position when the contact pressure is stopped by opening the valves 19 or by simply lifting the holding device 10 off the airplane component 40.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An apparatus for supporting a workpiece having a contoured surface, comprising:

a fluid reservoir arrangement containing and adapted to supply a pressurized hydraulic fluid;

a first support unit comprising a first cylinder, a first piston movably arranged in said first cylinder and bounding a variable-volume first chamber in said first cylinder, a first support element connected to said first piston and protruding from said first cylinder by a first variable extent dependent on a movable position of said first piston in said first cylinder, a first fluid passage connecting said first chamber with said fluid reservoir arrangement and establishing communication of said pressurized hydraulic fluid between said fluid reservoir arrangement and said first chamber, and a first valve interposed in said first fluid passage and adapted to be selectively opened and closed so as to selectively permit and shut-off said communication of said pressurized hydraulic fluid between said fluid reservoir arrangement and said first chamber, wherein said first support element is adapted to contact and support the contoured surface of the workpiece at a first location whereby said first support element protrudes from said first cylinder by a first protrusion amount that is dependent on and defined by a first position of the contoured surface at the first location, and wherein said variable-volume first chamber is the only variable-volume space to which said pressurized hydraulic fluid is communicated through said first valve so that when said first support element contacts said contoured surf ace and said first valve is closed then said variable-volume of said first chamber is invariably fixed at a respective existing first fixed volume and said first variable extent of protrusion of said first support element from said first cylinder is invariably fixed at said first protrusion amount; and a second support unit comprising a second cylinder, a second piston movably arranged in said second cylinder and bounding a variable-volume second chamber in said second cylinder, a second support element connected to said second piston and protruding from said second cylinder by a second variable extent dependent on a movable position of said second piston in said second cylinder, a second fluid passage connecting said second chamber with said fluid reservoir arrangement and establishing communication of said pressurized hydraulic fluid between said fluid reservoir arrangement and said second chamber, and a second valve interposed in said second fluid passage and adapted to be selectively opened and closed so as to selectively permit and shut-off said communication of said pressurized hydraulic fluid between said fluid reservoir arrangement and said second chamber, wherein said second support element is adapted to contact and support the contoured surface of the workpiece at a second location whereby said second support element protrudes from said second cylinder by a second protrusion amount that is dependent on and defined by a second position of the contoured surface at the second location, and wherein said variable-volume second chamber is the only variable-volume space to which said pressurized hydraulic fluid is communicated through said second valve so that when said second support element contacts said contoured surface and said second valve is closed then said variable-volume of said second chamber is invariably fixed at a respective existing second fixed volume and said second variable extent of protrusion of said second support element from said second cylinder is invariably fixed at said second protrusion amount.

2. The apparatus according to claim 1, wherein said fluid reservoir arrangement comprises a first fluid reservoir connected by said first fluid passage to said first chamber of said first support unit, and a second fluid reservoir connected by said second fluid passage to said second chamber of said second support unit, wherein said first fluid reservoir communicates fluidically only with said first chamber and not with said second chamber, and wherein said second fluid reservoir communicates fluidically only with said second chamber and not with said first chamber, and wherein said first and second fluid reservoirs are not in fluidic communication with one another.

3. The apparatus according to claim 1, wherein said fluid reservoir arrangement includes a reservoir cylinder, a pressurizing piston bounding a reservoir chamber in said reservoir cylinder, and a spring biasing said pressurizing piston, wherein said reservoir chamber contains said hydraulic fluid, and said spring biasing said pressurizing piston passively pressurizes said hydraulic fluid.

4. The apparatus according to claim 1, in combination with said workpiece, wherein said workpiece is an aircraft fuselage component that is to be supported to allow work to be performed thereon while being supported by said apparatus.

5. The apparatus according to claim 1, wherein said first and second valves respectively comprise a manual control.

6. The apparatus according to claim 1, further comprising an automatic control (22) including a memory (22') storing information representing said contoured surface of said workpiece, wherein said automatic control is adapted to produce individual control signals for individually closing each said valve thereby respectively locking each said support element respectively with said first and second protrusion amounts individually defined by said information representing said contoured surface independently of any other said support element.

7. The apparatus according to claim 1, further comprising a sensor (PS) and an automatic control (22) responsive to said sensor for producing a control signal for individually closing or opening said valves.

8. A method of using the apparatus according to claim 1 to support the workpiece having the contoured surface to allow work to be performed on the workpiece, said method comprising the steps:

a) with said first and second valves open, establishing contact of said first and second support elements with said contoured surface at said first and second locations respectively, wherein said first and second support elements adaptively yieldingly conform to said contoured surface at said first and second locations so that said first and second variable extents of protrusion adaptively yieldingly adjust to said first and second protrusion amounts respectively;

b) after said step a), closing said first valve so as to invariably fix said respective existing first fixed volume of said first chamber and thereby invariably fix said first protrusion amount of said first support element;

c) after said step a), closing said second valve so as to invariably fix said respective existing second fixed volume of said second chamber and thereby invariably fix said second protrusion amount of said second support element; and d) after said steps b) and c), while keeping said first and second valves closed, performing on said workpiece a work operation that non-uniformly applies onto said workpiece a force that is countered and supported by said support elements while maintaining said first and second protrusion amounts invariably fixed so that said contoured surface is supported without permitting any deformation of said workpiece.

9. The method according to claim 8, wherein said closing of said first valve and said closing of said second valve is controlled manually to invariably fix said first and second protrusion amounts when said first and second support elements are respectively contacting said contoured surface of said workpiece at said first and second locations.

10. The method according to claim 8, further comprising storing workpiece contour information representing said contoured surface of said workpiece in a memory, and based on said workpiece contour information producing control signals together representing said contoured surface and individually controlling said closing of said valves in response to said control signals.

11. The method according to claim 8, further comprising sensing an individual force or an individual pressure respectively between each one of said support elements and said contoured surface of said workpiece, producing a control signal in response to said individual force or said individual pressure, and respectively individually controlling said closing of said valves in response to said control signal.

* * * * *